US005167325A

United States Patent [19]

Sykora

[11] Patent Number: 5,167,325

[45] Date of Patent: Dec. 1, 1992

[54] CARRIER FOR CONTAINERS

[75] Inventor: John M. Sykora, Palos Hills, Ill.

[73] Assignee: Field Container Company, L.P., Elk Grove Village, Ill.

[21] Appl. No.: 804,282

[22] Filed: Dec. 9, 1991

[51] Int. Cl.[5] ..... B65D 75/00

[52] U.S. Cl. ..... 206/143; 206/140; 206/141; 206/162; 206/196; 229/40; 229/117.12; 53/48.8; 53/398

[58] Field of Search ..... 206/140, 141, 143, 147, 206/157, 162, 168, 169, 175, 194, 196, 200, 434; 229/40, 117.12, 117.13; 53/48.8, 398, 462; 493/88, 89

[56] References Cited

U.S. PATENT DOCUMENTS

| | | | |
|---|---|---|---|
| 2,603,923 | 7/1952 | Chidsey, Jr. | 206/141 |
| 2,654,474 | 10/1953 | Ringler | 206/141 |
| 2,815,857 | 10/1957 | Sester | 229/40 |
| 2,849,112 | 8/1958 | Forrer | 229/40 |
| 3,120,903 | 2/1964 | Cote | 206/141 |
| 3,432,029 | 3/1969 | Brown | 206/196 |
| 3,680,765 | 8/1972 | Harrelson | 206/140 |
| 3,687,282 | 8/1972 | Owen | 206/162 |
| 4,374,562 | 2/1983 | Oliff | 229/40 |

FOREIGN PATENT DOCUMENTS

| | | | |
|---|---|---|---|
| 171703 | 2/1986 | European Pat. Off. | 206/141 |

*Primary Examiner*—David T. Fidei

[57] ABSTRACT

A carrier for containers comprises a folded, generally stiff sheet, such as cardboard, defining a top wall, side walls, and a bottom wall. The carrier further defines apertures in the top wall for receiving the containers, with at least portions of the containers being positioned between the side walls. In accordance with this invention, the top wall defines a central, double-layered, integral handle portion of the folded sheet projecting outwardly from the remainder of the top wall. An inner sheet is positioned along the underside of the top wall and is attached to the folded sheet, to hold the handle portion in its outwardly projecting position.

14 Claims, 2 Drawing Sheets

CARRIER FOR CONTAINERS

BACKGROUND OF THE INVENTION

Containers for pop bottles, beverage cans, and the like that are currently available are made of typically a single sheet of cardboard which is wrapped about the containers and secured together, typically at the bottom of the containers by tab and aperture means so that the containers are wrapped in the cardboard carrier.

At the top of the carrier, which is generally substantially flat, a pair of finger holes are formed to facilitate gripping and carrying of the container.

However, the prior art carriers of this type have proven to be somewhat inconvenient in their means for carrying, in that it is generally deemed preferable to use as a carrier handle an upstanding flap having an aperture therethrough, through which generally the entire hand can pass for gripping the carrier in the manner of a suitcase handle, rather than reaching through finger holes in a flat top as in the prior art.

While it would be possible to attach a separate, upstanding flap to the folded sheet carrier of the prior art, that adds to the expense of the carrier. Also such an expedient would create the issue of mess from glue, as well as the possibility of accidental separation of the handle from the rest of the carrier, with the result that the containers may hit the ground and possibly break.

Thus, there is an inherent conflict between the concept of a carrier for containers made substantially of a single, folded sheet, and the presence of an upstanding handle portion extending from the top wall of the folded carrier.

In accordance with this invention, a folded sheet carrier for containers is provided, which exhibits the desired simplicity and low cost of such carriers, while at the same time providing an integral, upstanding handle portion, which is formed with the greatest of ease and little cost increase. Also, the upstanding handle portion is integral with the folded sheet that defines the carrier, so that there is no concern about separation of the handle portion from the rest of the carrier, as would be the case if a separate handle portion were glued into place on the carrier, or the like.

DESCRIPTION OF THE INVENTION

The invention of this application relates to a carrier for containers, with the carrier comprising a folded sheet defining a top wall, side walls, and a bottom wall. Typically, the folded sheet is made of cardboard, which includes stiff paper, corrugated board, and the like, or, if desired, plastic sheeting may be used.

The folded sheet that comprises the carrier may further define apertures in the top wall for receiving the containers, with at least portions of the containers being positioned between the side walls, being typically carried on the bottom wall within the carrier.

In accordance with this invention, the top wall defines a central, double-layered, integral handle portion of the folded sheet projecting outwardly from the remainder of the top wall. An inner sheet is positioned along the underside of the top wall, and is attached to the folded sheet in a manner which holds the handle portion in its outwardly projecting position.

Thus, the handle portion is merely a folded, integral portion of the total, folded sheet, being a double-layered handle portion typically of substantially inverted "V"-shaped configuration in cross-section. Basically, along the top wall, an integral portion thereof bends upwardly along a fold line by about 90°, and then bends downwardly again by a fold line of about 180°, followed by a third fold line on the order of 90°, to provide the structure of inverted "V"-shape. Thus, handles may be formed so that the integral, upstanding portion of the folded sheet is rather similar in look and function to a suitcase handle.

Preferably, the inner sheet is attached to the top wall on opposed sides of the handle portion by tab and aperture means formed by the inner sheet and the top wall. Specifically, the inner sheet may define tabs projecting through apertures defined by the top wall, with the tabs being in locked relation in the apertures against sides of the apertures which are proximate to the handle portion.

To complete the carrier of this invention, the folded sheet may be wrapped around the containers, with end portions thereof being joined together at the bottom wall, as in the prior art.

Thus, a plurality of containers may be placed into a carrier for the containers by a method comprising the following steps:

(1) Forming, in a self-supporting sheet by folding, an outwardly-projecting, double-layered, integral handle portion (2) One affixes an inner sheet to the side of the self-supporting sheet opposed to the outwardly-projecting handle portion. The inner sheet is so affixed on opposed sides of the handle portion to hold the handle portion in its outwardly-projecting position. It can be seen that in the absence of such an inner sheet, the outwardly-projecting handle portion could collapse as the top portion of the folded sheet expands laterally outwardly. (3) One then wraps the self-supporting sheet about the containers to form a loop with overlapping ends, then securing the overlapping ends together in a conventional tab and aperture arrangement, by gluing, or by any other desired means.

Thus, a carrier for bottles or cans is provided where it is made primarily of a single sheet that wraps around the containers, and has a relatively small inner sheet positioned along the lower surface of the carrier top, and attached thereto to hold the carrier top in a configuration where the double-layered, integral handle portion is provided. Such a structure exhibits significant improvements over corresponding structures of the prior art, and can be assembled without gluing, for the greatest simplicity and economy, coupled with improved customer acceptance.

DESCRIPTION OF THE DRAWINGS

Referring to the drawings.

DESCRIPTION OF SPECIFIC EMBODIMENTS

Figure 1:
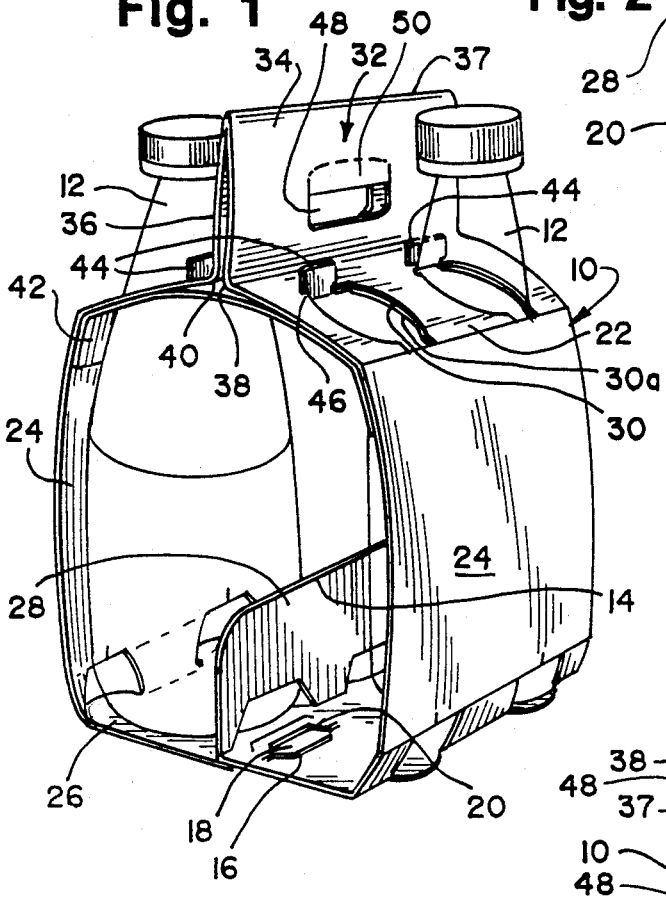
FIG. 1 is a perspective view of the carrier of this invention, with several bottles being carried therein.

Referring to the drawings, FIG. 1 shows a carrier in accordance with this invention which comprises a cardboard sheet 10 which is folded about a plurality of bottles 12 in the manner shown, with the respective end portions 14, 16 of the folded sheet being secured together along the bottom of the carrier by means of locking tabs 18 and apertures 20, to secure folded sheet 10 in a loop about the containers 12. Folded sheet 10 defines top wall 22, side walls 24, and a bottom wall 26 defined by the securance of the two end portions of folded sheet 10 together. End tab 28 may project upwardly between rows of containers 12, in part to serve as a bumper for glass bottles or the like.

Top wall 22 defines apertures 30 for receiving containers 12, with typically the majority of each container 12 being positioned below apertures 30, between side walls 24 and above bottom wall 26, to be enclosed in folded sheet 10.

In accordance with this invention, top wall 22 defines a central, integral handle portion 32 which comprises a pair of integral, folded sections 34, 36 of folded sheet 10, which are joined together at fold line 37 and which join the remainder of folded sheet 10 at fold lines 38, 40. Thus, upstanding handle member 32 is an integral portion of the original sheet 10 that is folded to become the carrier of this invention.

Figure 4:
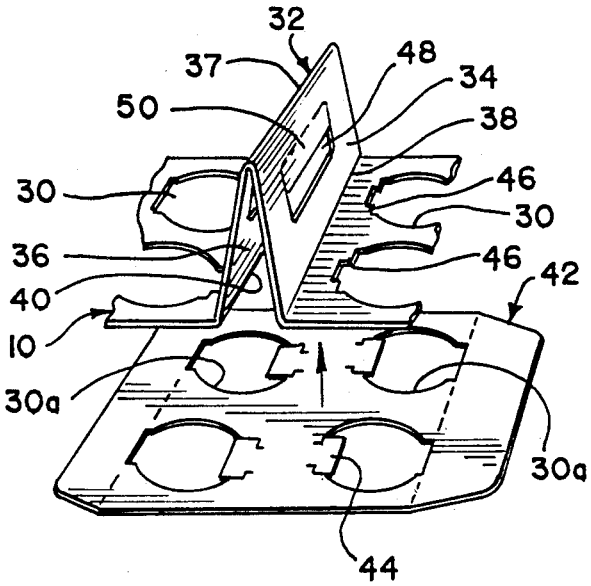
FIG. 4 is a fragmentary, perspective view showing how the top wall of the carrier may be folded to form the handle portion, and how the inner sheet may be applied to cause the handle portion to be retained in its upstanding configuration.
Figure 5:
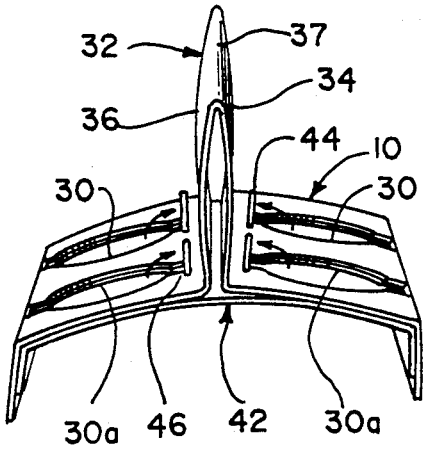
FIG. 5 is a fragmentary perspective view of the top of the carrier of this invention, without enclosed containers.
Figure 6:
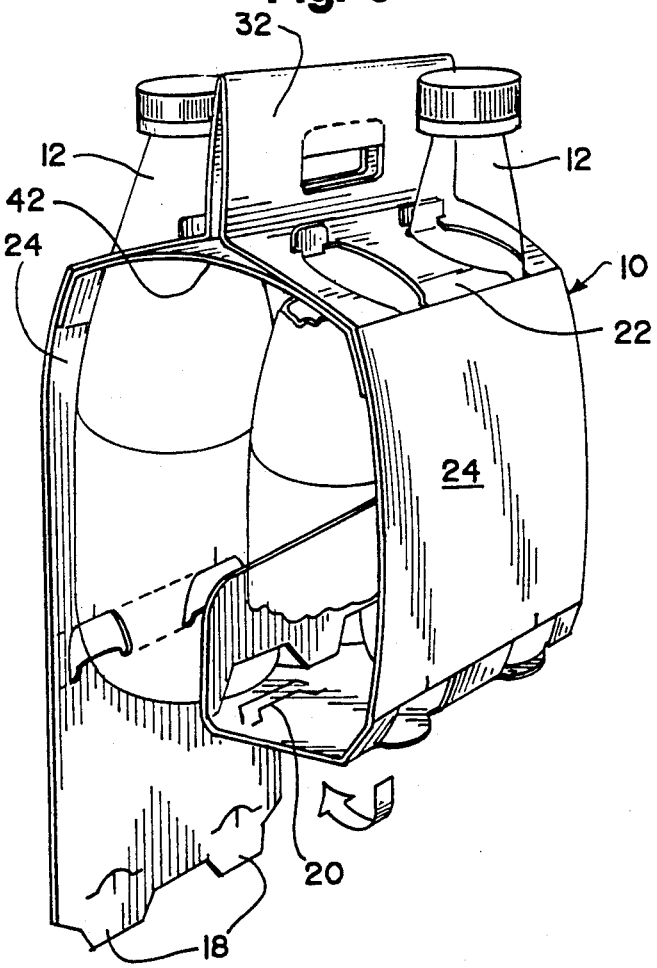
FIG. 6 is a perspective view showing how the folded sheet is brought around the respective containers retained in the carrier, with the overlapping ends of the folded sheet being affixed together by tab and aperture means.

The configuration of sheet 10, as described thus far, is inherently unstable, in that there is a tendency for handle member 32 to unfold, rather as indicated by FIG. 4, when compared with FIG. 1. Accordingly, inner sheet 42 is provided, being also typically made of cardboard and defining apertures 30*a* that are typically positioned to register with apertures 30, so that bottles 12 may extend through both of the registering apertures. Tabs 44 are defined adjacent the respective apertures 30*a*, so that as inner sheet 42 is positioned against the undersurface of top wall 22, and apertures 30, 30*a* are brought into alignment, tabs 44 may be folded upwardly so that lateral portions thereof may engage the step portions 46 in a conventional tab and aperture retention mode, to hold inner sheet 42 in its desired position along the underside of top wall 22. The respective tabs 44 are positioned so that they can engage with step portions 46 of the walls of apertures 30, as upstanding, integral handle portion 32 projects upwardly in its normal configuration as shown in FIGS. 1, 5 and 6. After attachment of inner sheet 42 in this manner, handle portion 32 is prevented from spreading outwardly again by the retentive action of inner sheet 42 through tabs 44.

The remainder of inner sheet 42 can rest smoothly along the underside of top wall 22 and, as shown, down the side walls 24 to any desired degree, resulting in a simple, reliable carrier having an upstanding handle. Hand holes 48 may be punched through both of the layers or panels 34, 36, with one or more folding flaps 50 being provided in conventional manner by the hand holes if desired.

Figure 2:
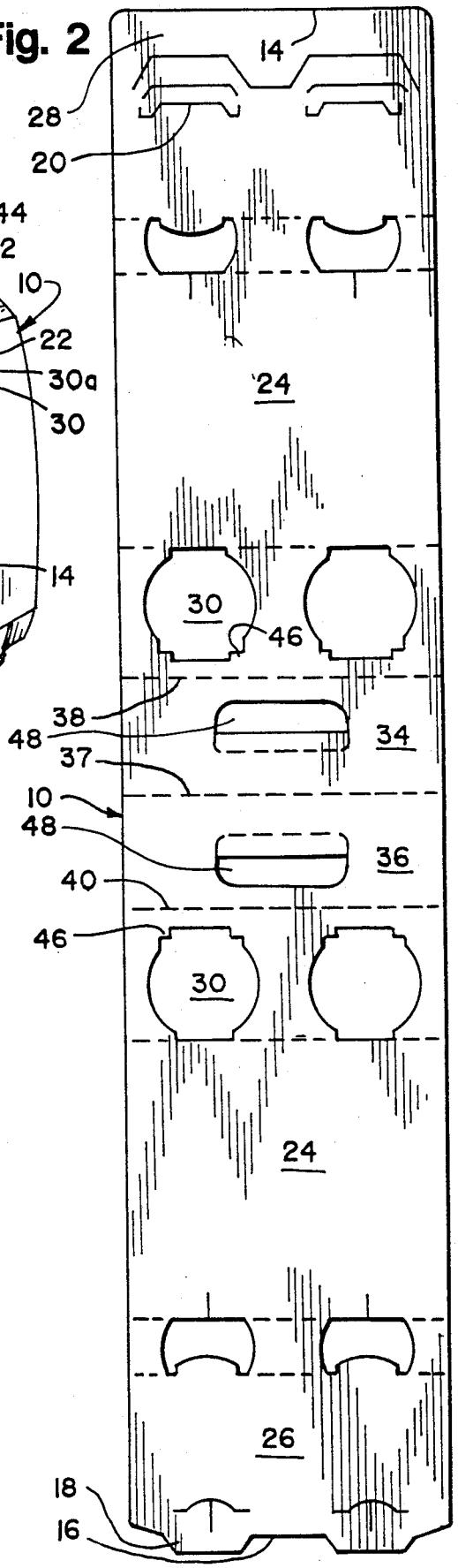
FIG. 2 is a plan view of a cardboard blank, which may be folded to comprise the folded sheet of the carrier of this invention.
Figure 3:
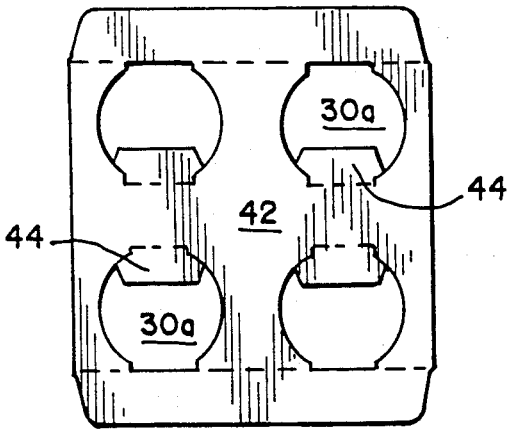
FIG. 3 is a plan view of a cardboard blank of the inner sheet, used in conjunction with the folded sheet of FIG. 2, to make the carrier of this invention.

FIGS. 2 and 3 illustrate the respective cardboard blanks of folded sheet 10 and inner sheet 42, from which the completed carrier for containers may be made as shown in FIG. 1, with a desirable, upstanding handle 32 and without gluing.

As shown particularly in FIGS. 4–6, the carrier and containers of this invention may be assembled by forming in self-supporting sheet 10 (FIG. 4), the outwardly projecting, double-layered, integral handle portion 32, followed by affixing inner sheet 42 to the side of self-supporting sheet 10 which is opposed to outwardly projecting handle 36. The respective apertures 30, 30*a* are placed in registration with each other; as particularly shown in FIGS. 1 and 5. One affixes inner sheet 42 to the main carrier sheet 10 by the folding of tabs 44 into stepped areas 46 at apertures 30. Thus, inner sheet 42 is so affixed on opposite sides of handle portion 32 that it holds the handle portion in its desired, outwardly projecting position.

Figure 7:
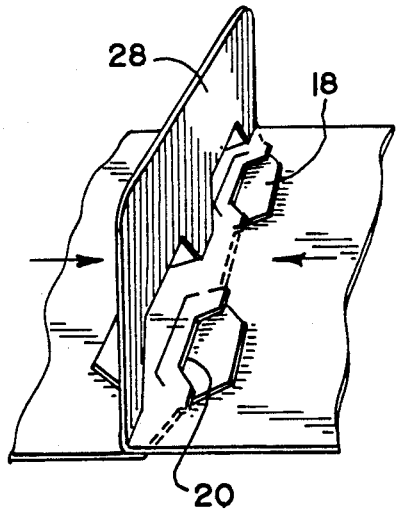
FIG. 7 is a fragmentary perspective view of the bottom of the carrier interior, with the containers removed, showing how one end of the folded sheet can overlap the other end by interacting tab and aperture means, to cause the two ends to be retained together with one end providing a central, upstanding portion.

Following this, one wraps the self-supporting carrier sheet 10 about the containers 12 to form a loop with overlapping ends as illustrated by FIG. 6, followed by securing the overlapping ends together with tabs 18 and slots 16 as shown in FIG. 7. The bottom fold and tab and slot securance system is of conventional design.

Thus, a carrier for containers is provided, being made of two typically cardboard sheets, and not requiring the use of gluing, to provide a highly inexpensive but highly convenient and reliable, reusable carrier for bottles and cans.

The above has been offered for illustrative purposes only, and is not intended to limit the scope of the invention of this application, which is as defined in the claims below.

I claim:

1. In a carrier for containers, said carrier comprising a folded sheet defining a top wall, side walls, and a bottom wall, and further defining apertures in said top wall for receiving said containers, with at least portions of said containers being positioned between said side walls, the improvement comprising, in combination:

said top wall defining a central, double-layered, integral handle portion of said folded sheet projecting outwardly from the remainder of said top wall, and an inner sheet attached to said top wall on opposed sides of said handle by tab and aperture means formed by said inner sheet and top wall, said inner sheet being positioned along the underside of said top wall and attached to said folded sheet, to hold said handle portion in its outwardly projecting position.

2. The carrier of claim 1 in which said double-layered handle portion is substantially of inverted "V"-shaped configuration in cross-section.

3. The carrier of claim 1 in which said inner sheet defines, on opposed sides of said handle portion, tabs projecting through apertures defined by said top wall, said tabs being in locked relation in said apertures against sides of said apertures proximal to said handle portion.

4. The carrier of claim 1 in which said folded sheet defines end portions that are joined together at said bottom wall.

5. The carrier of claim 1 in which said inner sheet defines, on opposed sides of said handle portion, tabs projecting through apertures defined by said top wall, said tabs being in locked relation in said apertures against sides of said apertures proximal to said handle portion.

6. The carrier of claim 1 in which said folded sheet and inner sheet are made of cardboard.

7. The carrier of claim 1 in which said inner sheet is attached to said top wall on opposed sides of said handle portion.

8. The carrier of claim 3 in which said handle portion defines handle holes.

9. The method of forming a carrier and placing a plurality of containers into said carrier, which comprises:

forming, in a self-supporting sheet by folding, an outwardly-projecting, double-layered, integral handle portion;

affixing an inner sheet to the side of said self-supporting sheet opposed to the outwardly-projecting handle portion by forming tabs and aperture means to secure said inner sheet without means of adhesive; so that the inner sheet is so affixed on opposed sides of said handle portion to hold the handle portion in its outwardly projecting position;

wrapping said self-supporting sheet about said containers to form a loop with overlapping ends; and securing said overlapping ends together.

10. In a carrier for containers, said carrier comprising a folded sheet defining a top wall, side walls and a bottom wall, and further defining apertures in said top wall for receiving said containers, with at least portions of said containers being positioned between said side walls, the improvement comprising, in combination:

said top wall defining a central, double-layered, integral handle portion of said folded sheet projecting outwardly from the remainder of said top wall, said handle portion being substantially of inverted "V"-shaped configuration in cross-section, and an inner sheet positioned along the underside of said top wall and attached to said folded sheet, to hold said handle portion in its outwardly projecting position, said inner sheet being attached to said top wall on opposed sides of said handle portion by tab and aperture means formed by said inner sheet and said top wall.

11. The carrier of claim 10 in which said folded sheet defines end portions that are joined together at said bottom wall.

12. The carrier of claim 11 in which said end portions are joined together by second tab and aperture means.

13. The carrier of claim 11 in which said tab and aperture means defines, on opposed sides of said handle portion, tabs projecting through apertures defined by said top wall, said tabs being in locked relation in said apertures against sides of said apertures which are proximal to said handle portion.

14. The carrier of claim 13 in which said handle portion defines hand holes.

* * * * *